US010584404B2

(12) United States Patent
Enneti et al.

(10) Patent No.: US 10,584,404 B2
(45) **Date of Patent: *Mar. 10, 2020**

(54) HIGH STRENGTH AND ABRASION RESISTANT BODY POWDER BLEND

(71) Applicant: Global Tungsten and Powders Corporation, Towanda, PA (US)

(72) Inventors: Ravi K. Enneti, Towanda, PA (US); Kevin Prough, Towanda, PA (US)

(73) Assignee: Global Tungsten & Powders Corp., Towanda, PA (US)

( * ) Notice: Subject to any disclaimer, the term of this patent is extended or adjusted under 35 U.S.C. 154(b) by 270 days.

This patent is subject to a terminal disclaimer.

(21) Appl. No.: 15/349,065

(22) Filed: Nov. 11, 2016

(65) Prior Publication Data

US 2018/0094342 A1 Apr. 5, 2018

Related U.S. Application Data

(60) Provisional application No. 62/402,113, filed on Sep. 30, 2016.

(51) Int. Cl.

| | |
|---|---|
| ***C09K 3/14*** | (2006.01) |
| ***C22C 29/08*** | (2006.01) |
| ***C22C 9/06*** | (2006.01) |
| ***E21B 10/46*** | (2006.01) |
| ***C22C 1/10*** | (2006.01) |
| *B24D 3/00* | (2006.01) |
| *B24D 3/02* | (2006.01) |
| *B24D 11/00* | (2006.01) |
| *B24D 18/00* | (2006.01) |
| *B22F 5/00* | (2006.01) |

(52) U.S. Cl.
CPC ..... *C22C 29/08* (2013.01); *C22C 1/1036* (2013.01); *C22C 9/06* (2013.01); *E21B 10/46* (2013.01); *B22F 2005/001* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,830,256 | A * | 11/1998 | Northrop | C22C 1/051 75/236 |
| 6,287,360 | B1 | 9/2001 | Kembaiyan et al. | |
| 2002/0078794 | A1 | 6/2002 | Bredthauer et al. | |
| 2010/0320004 | A1 | 12/2010 | Deng et al. | |

FOREIGN PATENT DOCUMENTS

| | | |
|---|---|---|
| CN | 105154742 B | 3/2017 |
| WO | PCT/US2018/050215 | 9/2018 |

OTHER PUBLICATIONS

Deshpande, P.K. et al. (2006) Infrared Processed Cu Composites Reinforced with WC Particles. Mater Sci Eng A. 429:58-65.
Gee, M.G. et al. (2007) Wear Mechanisms in Abrasion and Erosion of WC/Co and Related Hardmetals. Wear. 263:137-48.

(Continued)

*Primary Examiner* — James E McDonough
(74) *Attorney, Agent, or Firm* — Ballard Spahr LLP

(57) ABSTRACT

Matrix powder material and composites thereof, having improved strength, wear resistance, and abrasion resistance.

22 Claims, 1 Drawing Sheet

(56) References Cited

OTHER PUBLICATIONS

Hong, E. et al. (2011) Tribological Properties of Copper Alloy-Based Composites Reinforced with Tungsten Carbide Particles. Wear. 270:591-7.
Karimi, A. et al. (1995) Slurry Erosion Behavior of Thermally Sprayed WC-M Coatings. Wear. 186-7:480-6.
Kembaiyan, K.T. and Keshavan, K. (1995) Combating Severe Fluid Erosion and Corrosion of Drill Bits Using Thermal Spray Coating. Wear. 186-7:487-92.
Kennedy, R.K. et al. (2000) The Wetting and Spontaneous Infiltration of Ceramics by Molten Copper. J Mater Sci. 35:2909-12.
Larsson, P. et al. (1999) Wear of a New Type of Diamond Composite. Intl J Refrac Metals Hard Materials. 17(6):453-60.
Miserez, A. (2004) Particle Reinforced Metals of High Ceramic Content. Mater Sci Eng A. 387-9:822-31.
Reyes, M. and Neville, A. (2003) Degradation Mechanisms of Co-based Alloy and WC Metal-Matrix Composites for Drilling Tools Offshore. Wear. 255:143-56.
Sandstrom, M.J. (2003) The Solid Particle Erosion of Tungsten Carbide in Silicon Carbide Slurry. Master's Thesis, Department of Mechanical Engineering, University of Utah.
Zhou, R. et al. (2003) The Effect of Volume Fraction of WC Particles on Erosion Resistance of WC Reinforced Iron Matrix Surface Composites. Wear. 255:134-8.
International Search Report and Written Opinion dated Dec. 11, 2018 by the International Searching Authority for Patent Application No. PCT/US2018/050215, which was filed on Sep. 10, 2018 (Inventor-Ravi K. Enneti; Applicant-Global Tungsten & Powders Corp.) (8 pages).
Montgomery, R.S., The mechanism of percussive wear of tungsten carbide composites. Wear. 1968; 12:309-29.
U.S. Appl. No. 62/402,113, filed Sep. 30, 2016, Ravi K. Enneti et al.
U.S. Appl. No. 62/574,469, filed Oct. 19, 2017, Ravi K. Enneti (Global Tungsten and Powders Corp.).
U.S. Appl. No. 16/084,106, filed Sep. 11, 2018, Ravi K. Enneti (Global Tungsten and Powders Corp.).

* cited by examiner

HIGH STRENGTH AND ABRASION RESISTANT BODY POWDER BLEND

CROSS REFERENCE TO RELATED APPLICATIONS

The present application claims priority to U.S. Provisional Patent Application Ser. No. 62/402,113, filed on Sep. 30, 2016, which is incorporated herein fully by this reference.

BACKGROUND

Technical Field

The present disclosure relates to matrix powders that can be useful, for example, in the production of bodies or components for wear-resistant applications, to composites comprising such matrix powders, and to methods for making and using such matrix powders and composites.

Technical Background

Polycrystalline diamond cutter (PDC) bits, used extensively in the oil and gas exploration industry, can be subjected to harsh wear, erosion, and corrosion, during use in high temperature environments. Particle reinforced metal matrix composites (PRMMC) are frequently used in the manufacture of PDC bits to withstand the harsh operating conditions and to extend bit life and reduce drilling costs. Copper alloy reinforced with tungsten carbide (WC) particles is the current conventional PRMMC used in manufacturing PDC bits. While this reinforced copper alloy material exhibits useful strength, wear resistance, and toughness properties, there is a need for improved materials and methods that can provide improved strength, wear, and abrasion resistance. These needs and other needs are satisfied by the compositions and methods of the present disclosure.

SUMMARY

In accordance with the purpose(s) of the invention, as embodied and broadly described herein, this disclosure, in one aspect, relates to matrix materials and composites thereof, together with methods for the manufacture and use thereof.

In one aspect, the present disclosure provides a composite comprising at least about 15 wt. % ultra coarse tungsten carbide having a particle size from about 44 micrometers to about 63 micrometers, and from about 8 wt. % to about 20 wt. % nickel.

In another aspect, the present disclosure provides a composite comprising from about 20 wt. % to about 28 wt. % ultra coarse tungsten carbide having a particle size from about 44 micrometers to about 63 micrometers, from about 8 wt. % to about 20 wt. % nickel, and further comprising one or more of: (a) from about 0 wt. % to about 2 wt. % of a second fraction of ultra coarse tungsten carbide having a particle size greater than about 250 micrometers, (b) from about 0 wt. % to about 8 wt. % of a third fraction of ultra coarse tungsten carbide having a particle size from about 177 micrometers to about 250 micrometers, (c) from about 10 wt. % to about 25 wt. % of a fourth fraction of ultra coarse tungsten carbide having a particle size from about 125 micrometers to about 177 micrometers, (d) from about 12 wt. % to about 18 wt. % of a fifth fraction of ultra coarse tungsten carbide having a particle size from about 88 micrometers to about 125 micrometers, (e) from about 15 wt. % to about 22 wt. % of a sixth fraction of tungsten carbide having a particle size from about 63 micrometers to about 88 micrometers, (f) and from about 25 wt. % to about 50 wt. % of a seventh fraction of ultra coarse tungsten carbide having a particle size smaller than about 44 micrometers In another aspect, the present disclosure provides a composite as described above, being infiltrated with a copper containing alloy.

In yet another aspect, the present disclosure provides a composite as described above, having no or substantially no cast carbide.

In still another aspect, the present disclosure provides a method for preparing a composite, the method comprising contacting ultra coarse tungsten carbide and from about 8 wt. % to about 20 wt. % nickel, wherein at least a portion of the ultra coarse tungsten carbide has a particle size from about 44 micrometers to about 63 micrometers.

In still another aspect, the present disclosure provides a cutting tool comprising an infiltrated composite as described above.

BRIEF DESCRIPTION OF THE FIGURES

The accompanying figures, which are incorporated in and constitute a part of this specification, illustrate several aspects and together with the description serve to explain the principles of the invention.

Figure 1:
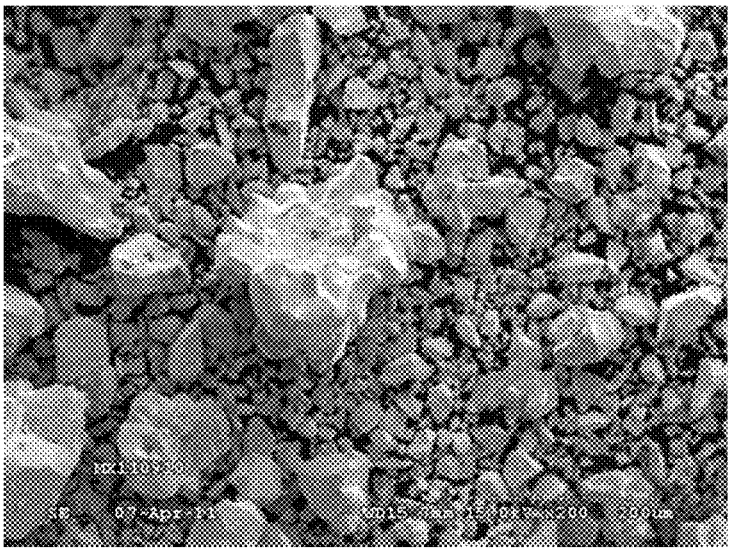
FIG. 1 illustrates the morphology of an ultra-coarse tungsten carbide (UC-WC) powder, in accordance with various aspects of the present disclosure.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION

The present invention can be understood more readily by reference to the following detailed description of the invention and the Examples included therein.

Before the present compounds, compositions, articles, systems, devices, and/or methods are disclosed and described, it is to be understood that they are not limited to specific synthetic methods unless otherwise specified, or to particular reagents unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

All publications mentioned herein are incorporated herein by reference to disclose and describe the methods and/or materials in connection with which the publications are cited.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, example methods and materials are now described.

As used herein, unless specifically stated to the contrary, the singular forms "a," "an" and "the" include plural referents unless the context clearly dictates otherwise. Thus, for example, reference to "a filler" or "a solvent" includes mixtures of two or more fillers, or solvents, respectively.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "optional" or "optionally" means that the subsequently described event or circumstance can or can not occur, and that the description includes instances where said event or circumstance occurs and instances where it does not.

Disclosed are the components to be used to prepare the compositions of the invention as well as the compositions themselves to be used within the methods disclosed herein. These and other materials are disclosed herein, and it is understood that when combinations, subsets, interactions, groups, etc. of these materials are disclosed that while specific reference of each various individual and collective combinations and permutation of these compounds can not be explicitly disclosed, each is specifically contemplated and described herein. For example, if a particular compound is disclosed and discussed and a number of modifications that can be made to a number of molecules including the compounds are discussed, specifically contemplated is each and every combination and permutation of the compound and the modifications that are possible unless specifically indicated to the contrary. Thus, if a class of molecules A, B, and C are disclosed as well as a class of molecules D, E, and F and an example of a combination molecule, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the compositions of the invention. Thus, if there are a variety of additional steps that can be performed it is understood that each of these additional steps can be performed with any specific embodiment or combination of embodiments of the methods of the invention.

Each of the materials disclosed herein are either commercially available and/or the methods for the production thereof are known to those of skill in the art.

It is understood that the compositions disclosed herein have certain functions. Disclosed herein are certain structural requirements for performing the disclosed functions, and it is understood that there are a variety of structures that can perform the same function that are related to the disclosed structures, and that these structures will typically achieve the same result.

Unless specifically referred to the contrary herein, WC is intended to refer to monocrystalline tungsten carbide. It should be understood that monocrystalline tungsten carbide can be substantially monocrystalline, but that small amounts of other tungsten carbide materials or can be present.

Unless specifically referred to the contrary herein, CC is intended to refer to a cast carbide, a eutectic mixture of WC and $W_2C$.

Unless specifically referred to the contrary herein, Transverse Rupture Strength (TRS) is intended to refer to the stress in a material just before it yields in a flexural test.

Unless specifically referred to herein, UC-WC is intended to refer to an ultra-coarse tungsten carbide powder. An UC-WC powder can, in various aspects, be manufactured from tungsten metal powder blended with carbon and subjected to temperatures high enough and for a time sufficient to coarsen the powder into particles of the desired sieve size. The UC-WC formation process is diffusion limited and is thus, thermally driven. Thus, the process is preferably performed at temperatures of at least about 2,200° C. or greater. While lower temperatures can be employed, such temperatures can extend cycle times to unreasonable lengths. In one aspect, carburization of the powder can be performed in small, self-contained elements, for example, having a volume of about 1 $in^3$ each. In an exemplary aspect, a tungsten metal powder (WMP), such as for example, an M63 (available from Global Tungsten & Powders Corp., Towanda, Pa., USA) having an average particle size of from about 7.90 μm to about 10.90 μm (ASTM B330), a bulk density of from about 55 $g/in^3$ to about 90 $g/in^3$ (ASTM B329), a loss on reduction (LOR) of about 0.10% (ASTM E159), and about 99.95% purity, and an N990 carbon black can be ball-milled to a target carbon loading of 6.00 wt. %. The resulting mixture can be placed in a self-contained element, as described above, and carburized under a flow of nitrogen. After carburization, the resulting piece can be broken into smaller pieces and then subjected to high energy comminution via hammermilling using, for example, a Model WA-8-H Hammermill from Schutte Buffalo, Buffalo, N.Y., USA. UC-WC powders are commercially available, for example, from Global Tungsten & Powders, Towanda, Pa., USA. The morphology of an exemplary UC-WC powder is illustrated in FIG. 1.

It should be understood that the present disclosure refers to various particle size fractions and that the particle size of any of the materials described herein are distributional properties. Accordingly, a particle size fraction can, in various aspects, comprise a small amount of particles either larger than or smaller than the given size fraction. It should also be understood that the average size of any given particle size fraction can vary. In one aspect, a size fraction of a material can be represented by standard U.S. sieve sizes. In an exemplary aspect, a fraction can be defined as 230/325, meaning that the particles pass through the holes of a 230 mesh screen (i.e., 63 μm opening) but not through the holes of a 325 mesh screen (i.e., 44 μm opening).

References to B611 are intended to refer to ASTM B611-13 (Standard Test Method for Determining the High Stress Abrasion Resistance of Hard Materials). The B611 test is designed to simulate high-stress abrasion conditions. Unlike low-stress abrasion techniques, where the abrasive remains relatively intact during testing, the B611 test simulates applications where the force between an abrasive substance and a surface is sufficient to crush the abrasive. The B611 test employs a water slurry of aluminum oxide particles as the abrasive medium and a rotating steel wheel to force the abrasive across a flat test specimen in line contact with the rotating wheel immersed in the slurry. The values states in SI units are to be regarded as standard.

As briefly described above, the present disclosure provides materials useful in the manufacture of, for example, cutting tools, together with methods for the manufacture and use thereof. Polycrystalline diamond cutter (PDC) bits, used extensively in the oil and gas exploration industry, can be subjected to harsh wear, erosion, and corrosion, during use in high temperature environments. Particle reinforced metal matrix composites (PRMMC) are frequently used in the manufacture of PDC bits to withstand the harsh operating conditions and to extend bit life and reduce drilling costs. Conventional PRMMC materials utilize a copper alloy reinforced with tungsten carbide (WC) particles. The use of copper alloy can provide good interfacial bonding due to the wettability of copper for WC and the absence of intermetallic formation due to the low solubility of WC in the copper.

The copper alloy used in conventional PRMMC materials can vary, but can, in various aspects, comprise Cu, 24% Mn, 15% Ni, and 8% Zn.

While some conventional PRMMC materials comprise mixtures of UC-WC and CC materials, a fundamental understanding of the specific properties of each material, and especially of various size fractions of each material, have limited the development of PRMMC materials. By understanding these properties (e.g., bulk density, tap density, morphology, etc.), the present disclosure provides an inventive combination of materials that can exhibit improved strength, wear resistance, and/or abrasion resistance over conventional PRMMC materials.

The infiltrated TRS and wear samples were prepared by initially filling the various size fractions of UC-WC powders and 15 wt. % Ni into a graphite mold. On the top of the carbide powder, the Cu based alloy (Cu-24% Mn-15% Ni-8% Zn) granules and borax-boric acid flux were placed in the graphite mold. The graphite mold was then heated in a furnace at 1200° C. for 1 h in air to infiltrate the Cu alloy into the powders. After infiltration, the graphite mold was broken and the infiltrated sample obtained. Cylinder shape infiltrated samples of approximately 1.27 cm diameter×8.57 cm height were prepared for measuring the TRS samples. Six samples for TRS testing were obtained from one infiltration. The rectangular shaped infiltrated sample was machined further to obtain the wear sample of dimensions approximately 0.95 cm×2.54 cm×5.4 cm. Four samples for wear testing were obtained from one infiltration. Wear data for infilterated samples was determined using the ASTM B611 test system (Falex Corporation) with a steel wheel. The wear tests were carried for 500 revolutions of the steel wheel (16.9 cm diameter) in a slurry containing 2000 g of abrasive material and 25 wt. % water. The volume loss after 500 revolutions was multiplied by a factor of 1.46 to estimate the volume loss after 1,000 revolutions. An increase in strength and abrasion resistance was observed for infiltrated samples of as received UC-WC containing various size fractions of powders with an addition of 15 wt. % Ni. Evaluation of these infiltrated samples confirmed superior properties as compared to previously manufactured materials, including higher transverse rupture strength, good infiltration, uniform microstructure, and superior erosion resistance.

The strength of the infiltrated samples was measured using a three point bend test and the abrasion properties were measured via B611.

Effect of Nickel Addition on as-Received (Unsifted) UC-WC Powder:

In another aspect, the effect of Ni addition on as-received UC-WC powder was evaluated. Such as-received powders were not sifted to separate fine and coarse fractions. The size distribution and powder properties of three production lots are shown in Table 1.

TABLE 1

Powder properties of UC-WC production lots used to study the effect of Ni.

| | MX051815A (MXA) | MX051815B (MXB) | MX051815C (MXC) |
|---|---|---|---|
| +60 (%) | 0 | 0.1 | 0 |
| −60 + 80 (%) | 0.4 | 0.3 | 1.3 |
| −80 + 120 (%) | 23 | 11.4 | 17.9 |
| −120 + 170 (%) | 17.8 | 12.8 | 15.4 |
| −170 + 230 (%) | 20.8 | 18.2 | 18.9 |
| −230 + 325 (%) | 24.4 | 23.6 | 23.4 |
| −325 (%) | 13.7 | 33.7 | 23.1 |
| Apparent density ($g/cm^3$) | 7.21 | 7.59 | 7.26 |
| Tap density ($g/cm^3$) | 8.77 | 9.56 | 8.98 |
| Hall flow (s/50 g) | 11 | 12 | 11 |

In another aspect, the data in Table 1 shows a large variation in amount of −325 mesh fraction between the three production lots. Body powder blends of the three unsifted production lots were prepared by adding 15% wt. % Ni, and then infiltrating with copper alloy before evaluating strength and abrasion resistance. In one aspect, the amount of nickel contacted and/or mixed with a body powder material or blend thereof is separate from any nickel that can be present in an infiltration alloy.

The strength for each of the three production lots, both without Ni and with 15 wt. % Ni, are detailed in Table 2. A significant increase in strength of each of the UC-WC production lots was observed with the addition of Ni. A fourth sample was prepared with 15 wt. % Ni and evaluated. An increase in strength of from about 50% to about 172% was achieved with addition of 15 wt. % Ni. The strength of each of the three UC-WC production lots with 15 wt. % Ni was higher than the previously prepared GTP body powder blends.

TABLE 2

The strength data of infiltrated UC-WC production lots with and without Ni

| | | | % Increase in strength (KSI) | |
|---|---|---|---|---|
| Sample | Wt. % Ni | TRS (KSI) | Initial | GTP 90 |
| MX051815A | 0 | 67 | | −54% |
| MX051815B | 0 | 126 | | −13% |
| MX051815C | 0 | 73 | | −49% |
| MX051815A | 15 | 182 | 172% | 27% |
| MX051815B | 15 | 195 | 55% | 35% |

TABLE 2-continued

The strength data of infiltrated UC-WC production lots with and without Ni

| Sample | Wt. % Ni | TRS (KSI) | % Increase in strength (KSI) Initial | GTP 90 |
|---|---|---|---|---|
| MX051815C | 15 | 193 | 164% | 34% |
| MX051815BR | 15 | 189 | 50% | 31% |

Figure 2:
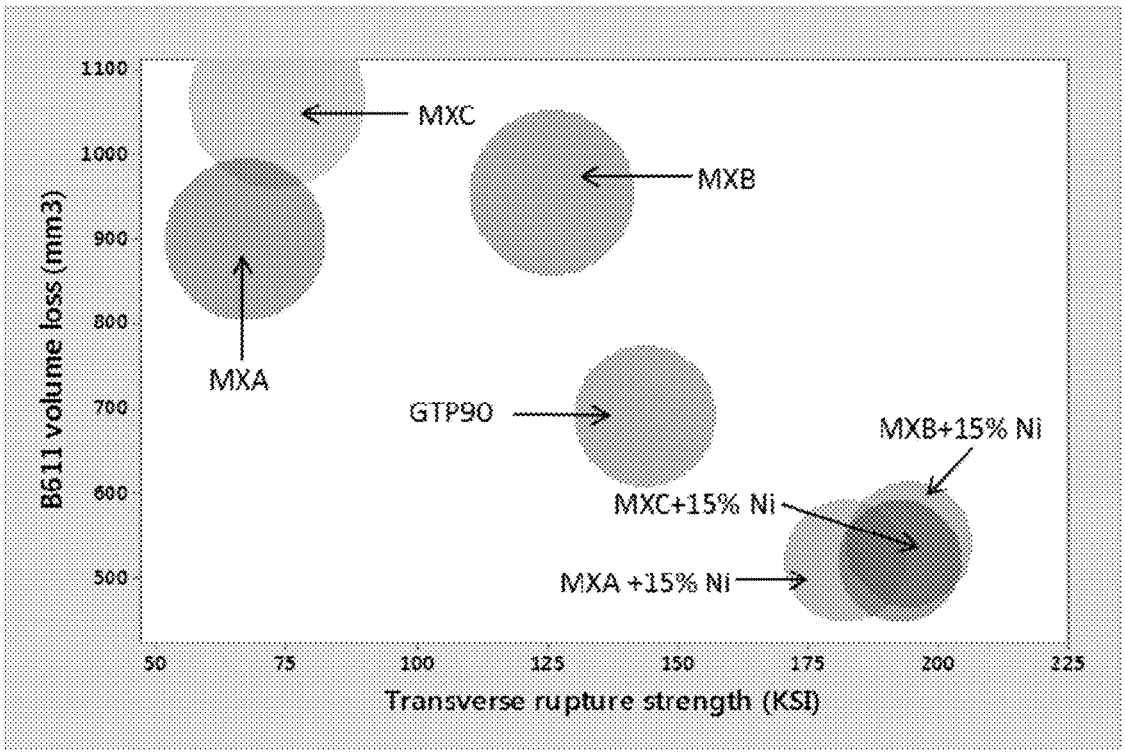
FIG. 2 is a bubble plot illustrating the variation of volume loss during ASTM B611 wear testing vs. Transverse Rupture Strength (TRS) for UC-WC materials containing differing amounts of nickel.

In another aspect, abrasion resistance (i.e., volume loss) vs strength for each of the unsifted production lots of UC-WC, both with and without Ni, is illustrated in the bubble plot of FIG. 2. Similar to the coarse and fine UC-WC powder fractions, the addition of Ni resulted in a significant improvement in abrasion resistance (lower volume loss) of the UC-WC production lots. In comparison, the unsifted UC-WC production lots exhibited low strength and inferior abrasion resistance properties.

Next Generation Body Powder Blends:

In another aspect, UC-WC production lot with 15 wt. % Ni (MXB+15% Ni) were evaluated for strength and abrasion resistance: a UC-WC production lot with 15 wt. % Ni (referred to as MXB+15% Ni) exhibited superior strength and abrasion resistance, as compared to GTP90.

Statistical analysis was carried out to estimate the number of repetitions/samples required to confirm the superior properties of next generation body powder blends. Based on this analysis, strength measurements on 12 samples and abrasion resistance on 24 samples were carried out to confirm the superior properties of the next generation body powder blends described above. The average strength data from the 12 samples is detailed in Table 3, illustrating the repeatability of superior strength, as compared to a previously prepared sample designated GTP90. GTP90 is a standard body powder available in market for manufacturing polycrystalline diamond cutter (PDC) bits.

TABLE 3

Strength data from 12 samples of potential next generation body powder

| Material | TRS (KSI) | % Increase in strength (KSI) GTP 90 |
|---|---|---|
| MXB + 15% Ni | 192 ± 15.3 | 33% |

The average volume loss from abrasion testing of the 24 samples is detailed in Table 4. The data shows superior abrasion resistance (lower volume loss) of each of the samples, as compared to GTP90.

TABLE 4

Average volume loss during B611 wear testing of 24 samples from each potential next generation body powder blend

| Material | Vol.loss ($mm^3$) | GTP90 Vol.loss ($mm^3$) |
|---|---|---|
| MXB + 15% Ni | 540 ± 30 | 691 ± 36 |

MXB+15% Ni, also designated GTP170AR, exhibited improved strength and abrasion resistance, as compared to the previously prepared samples. Exemplary specifications for this sample are detailed below in Table 5.

TABLE 5

Specification developed for GTP 170 AR body powder blend

| Property | GTP 170 AR |
|---|---|
| Hall Density | 5.3-7.0 $g/cm^3$ |
| Tap Density | 7.6-9.0 $g/cm^3$ |
| Hall Flow | Info Only |
| +60 mesh | 2.0 wt % Max |
| −60 + 80 mesh | 8.0 wt % Max |
| −80 + 120 mesh | 10-25 wt % |
| −120 + 170 mesh | 12-18 wt % |
| −170 + 230 mesh | 15-22 wt % |
| −230 + 325 mesh | 20-28 wt % |
| −325 mesh | 25-50 wt % |
| Ni | 14.5-15.5% |
| Fe | 0.4% Max |
| Free Carbon | 0.08% Max |
| Al | 1000 ppm max |
| Co | 1.5-2.5% |
| Mo | 1000 ppm max |
| Nb | 1000 ppm max |
| Ta | 2000 ppm max |
| Ti | 1000 ppm max |
| TRS | 170 KSI min |
| Carbon Total | 5.0-5.4% |

Thus, in one aspect, the present disclosure provides a composite comprising at least about 15 wt. %, for example, about 15, 16, 17, 18, 19, 20 wt. % or more of ultra coarse tungsten carbide having a particle size from about 44 micrometers to about 63 micrometers, and from about 8 wt. % to about 20 wt. %, for example, about 8, 9, 10, 11, 12, 13, 14, 15, 16, 17, 18, 19, or 20 wt. % Ni. In another aspect, the composite comprises at least about 20 wt. % ultra coarse tungsten carbide having a particle size from about 44 micrometers to about 63 micrometers. In still another aspect, the composite comprises from about 20 wt. % to about 28 wt. %, for example, about 20, 21, 22, 23, 24, 25, 26, 27, or 28 wt. % ultra coarse tungsten carbide having a particle size from about 44 micrometers to about 63 micrometers. In another aspect, the composite comprises from about 18 wt. % to about 22 wt. %, for example, about 18, 19, 20, 21, or 22 wt. % ultra coarse tungsten carbide having a particle size from about 44 micrometers to about 63 micrometers.

In yet another aspect, the composite comprises about 0 wt. % to about 2 wt. %, for example, about 0, 0.5, 1, 1.5, or 2 wt. % of a second fraction of ultra coarse tungsten carbide having a particle size greater than about 250 micrometers. In another aspect, the composite comprises from about 0 wt. % to about 8 wt. %, for example, about 0, 0.5, 1, 1.5, 2, 2.5, 3, 3.5, 4, 4.5, 5, 5.5, 6, 6.5, 7, 7.5, or 8 wt. % of a third fraction of ultra coarse tungsten carbide having a particle size from about 177 micrometers to about 250 micrometers. In yet another aspect, the composite comprises one or more of: (a) from about 0 wt. % to about 2 wt. % of a second fraction of ultra coarse tungsten carbide having a particle size greater than about 250 micrometers, (b) from about 0 wt. % to about 8 wt. % of a third fraction of ultra coarse tungsten carbide having a particle size from about 177 micrometers to about 250 micrometers, (c) from about 10 wt. % to about 25 wt. % of a fourth fraction of ultra coarse tungsten carbide having a particle size from about 125 micrometers to about 177 micrometers, (d) from about 12 wt. % to about 18 wt. % of a fifth fraction of ultra coarse tungsten carbide having a particle size from about 88 micrometers to about 125 micrometers, (e) from about 15 wt. % to about 22 wt. % of a sixth fraction of tungsten carbide having a particle size from about 63 micrometers to about 88 micrometers, (f) and from about 25 wt. % to about 50 wt. % of a seventh fraction of ultra coarse tungsten carbide having a particle size smaller than about 44 micrometers.

In another aspect, the composite comprises from about 0 wt. % to about 2 wt. % of a second fraction of ultra coarse tungsten carbide having a particle size greater than about 250 micrometers, from about 0 wt. % to about 8 wt. % of a third fraction of ultra coarse tungsten carbide having a particle size from about 177 micrometers to about 250 micrometers, from about 10 wt. % to about 25 wt. % of a fourth fraction of ultra coarse tungsten carbide having a particle size from about 125 micrometers to about 177 micrometers, from about 12 wt. % to about 18 wt. % of a fifth fraction of ultra coarse tungsten carbide having a particle size from about 88 micrometers to about 125 micrometers, from about 15 wt. % to about 22 wt. % of a sixth fraction of tungsten carbide having a particle size from about 63 micrometers to about 88 micrometers, and from about 25 wt. % to about 50 wt. % of a seventh fraction of ultra coarse tungsten carbide having a particle size smaller than about 44 micrometers.

In one aspect, the composite comprises from about 10 wt. % to about 18 wt. % nickel, such as, for example, about 10, 11, 12, 13, 14, 15, 16, 17, or 18 wt. %. In another aspect, the composite comprises from about 14 wt. % to about 16 wt. %, for example, about 14, 14.2, 14.4, 14.6, 14.8, 15, 15.2, 15.4, 15.6, 15.8, or 16 wt. % nickel. In still another aspect, the composite comprises from about 14.5 wt. % to about 15.5 wt. %, for example, about 14.5, 14.6, 14.7, 14.8, 14.9, 15, 15.1, 15.2, 15.3, 15.4, or 15.5 wt. % nickel.

In another aspect, the composite comprises one of more of the properties and/or size fractions recited in Table 5, at the concentration also recited in Table 5. In another aspect, the composite comprises all or any combination of the size fractions recited in Table 5, at the concentrations recited in Table 5. In yet another aspect, any size fraction can be defined by the particle size range and/or a mesh size range (e.g., −230+325), and it should be understood that any of the ranges can be utilized, for example, those in Table 5, to describe a given fraction of material.

In one aspect, the composite is infiltrated with a copper containing alloy. In another aspect, the composite is infiltrated with an alloy comprising copper, manganese, and zinc.

In one aspect, the composite comprises no or substantially no cast carbide. In another aspect, the composite comprises no cast carbide. In still another aspect, the composite can comprise a cast carbide.

In one aspect, the composite has a tap density of at least about 7.0 g/cm$^3$, for example, about 7.0, 7.2, 7.4, 7.6, 7.8, 8, 8.2, 8.4, 8.6, 8.8, 9, 9.2, 9.4, 9.6 g/cm$^3$ or more. In another aspect, the composite has a tap density of from about 7.6 g/cm$^3$ to about 9 g/cm$^3$.

In another aspect, nickel contacted with a powder has an average particle size of less than about 44 micrometers. In still another aspect, the composite has a transverse rupture strength of at least about 170 KSI.

In one aspect, an infiltrated composite has a volume loss under abrasion testing according to ASTM B611 of less than about 500 mm$^3$.

In one aspect, the inventive composite can be prepared by contacting ultra coarse tungsten carbide and from about 8 wt. % to about 20 wt. % nickel, wherein at least a portion of the ultra coarse tungsten carbide has a particle size from about 44 micrometers to about 63 micrometers. In another aspect, the inventive composite can be prepared as described above, wherein at least about 20 wt. % of the composite comprises ultra coarse tungsten carbide having a particle size from about 44 micrometers to about 63 micrometers. In another aspect, the inventive composite can be prepared as described above, wherein from about 20 wt. % to about 28 wt. % of the composite comprises ultra coarse tungsten carbide having a particle size from about 44 micrometers to about 63 micrometers. In still another aspect, the inventive composite can be prepared as described above, wherein from about 18 wt. % to about 22 wt. % of the composite comprises ultra coarse tungsten carbide having a particle size from about 44 micrometers to about 63 micrometers. In still another aspect, the inventive composite can be prepared as described above, wherein from about 0 wt. % to about 2 wt. % of the composite comprises ultra coarse tungsten carbide having a particle size greater than about 250 micrometers. In another aspect, the inventive composite can be prepared as described above, wherein from about 0 wt. % to about 8 wt. % of the composite comprises ultra coarse tungsten carbide having a particle size from about 177 micrometers to about 250 micrometers.

In one aspect, the inventive composite can be prepared as described above, by further comprising contacting one or more of: (a) from about 0 wt. % to about 2 wt. % of a second fraction of ultra coarse tungsten carbide having a particle size greater than about 250 micrometers, (b) from about 0 wt. % to about 8 wt. % of a third fraction of ultra coarse tungsten carbide having a particle size from about 177 micrometers to about 250 micrometers, (c) from about 10 wt. % to about 25 wt. % of a fourth fraction of ultra coarse tungsten carbide having a particle size from about 125 micrometers to about 177 micrometers, (d) from about 12 wt. % to about 18 wt. % of a fifth fraction of ultra coarse tungsten carbide having a particle size from about 88 micrometers to about 125 micrometers, (e) from about 15 wt. % to about 22 wt. % of a sixth fraction of tungsten carbide having a particle size from about 63 micrometers to about 88 micrometers, (f) and from about 25 wt. % to about 50 wt. % of a seventh fraction of ultra coarse tungsten carbide having a particle size smaller than about 44 micrometers. In still another aspect, the inventive composite can be prepared by further comprising contacting from about 0 wt. % to about 2 wt. % of a second fraction of ultra coarse tungsten carbide having a particle size greater than about 250 micrometers, from about 0 wt. % to about 8 wt. % of a third fraction of ultra coarse tungsten carbide having a particle size from about 177 micrometers to about 250 micrometers, from about 10 wt. % to about 25 wt. % of a fourth fraction of ultra coarse tungsten carbide having a particle size from about 125 micrometers to about 177 micrometers, from about 12 wt. % to about 18 wt. % of a fifth fraction of ultra coarse tungsten carbide having a particle size from about 88 micrometers to about 125 micrometers, from about 15 wt. % to about 22 wt. % of a sixth fraction of tungsten carbide having a particle size from about 63 micrometers to about 88 micrometers, and from about 25 wt. % to about 50 wt. % of a seventh fraction of ultra coarse tungsten carbide having a particle size smaller than about 44 micrometers.

In other aspects, the composite can be prepared as described above, wherein nickel comprises from about 10 wt. % to about 18 wt. % of the composite. In still other aspects, the composite can be prepared as described above, wherein nickel comprises from about 14 wt. % to about 16 wt. % of the composite. In still other aspects, the composite can be prepared as described above, wherein nickel comprises from about 14.5 wt. % to about 15.5 wt. % of the composite.

In one aspect, the inventive composite can be prepared by contacting the ultra coarse tungsten carbide and copper to infiltrate the a copper containing alloy. In yet another aspect, the copper containing alloy comprises copper, manganese, and zinc.

In one aspect, the inventive composite can be prepared using nickel.

In another aspect, the inventive composite can be prepared using no or substantially no cast carbide. In another aspect, the inventive composite can be prepared by contacting the UC-WC with a cast carbide.

In one aspect, the inventive composite can be prepared as described above, wherein the nickel has an average particle size of less than about 44 micrometers.

In another aspect, an infiltrated composite can be used to manufacture a cutting tool. In still another aspect, such a cutting tool can comprise one or more cutting surfaces. In another aspect, such a cutting tool can comprise a bit, such as, for example, a drill bit or a portion thereof.

In another aspect, the inventive composite can exhibit a uniform or substantially uniform composition. In another aspect, the inventive composite does not have a core/shell structure. In yet another aspect, an infiltrated composite can exhibit a uniform or substantially uniform composition. In still another aspect, an infiltrated composite does not have a core/shell structure.

In yet another aspect, the composite can comprise one or more organic additives added to the UC-WC powders and Ni prior to infiltration. In one aspect, an organic additive can be added at a rate of about 1 cc additive per kg of powder. While not wishing to be bound by theory, it is believed that the organic additive can assist in minimizing segregration of powders, resulting in an infiltrated part having uniform or substantially uniform strength. While not wishing to be bound by theory, it is believed that the presence of such an organic additive can reduce and/or eliminate segregation and can, in various aspects, improve the standard deviation of strength measurements obtained for a given composite material.

The present invention can be described in various non-limiting aspects, such as the following.

Aspect 1: A composite comprising at least about 15 wt. % ultra coarse tungsten carbide having a particle size from about 44 micrometers to about 63 micrometers, and from about 8 wt. % to about 20 wt. % nickel.

Aspect 2: The composite of Aspect 1, comprising at least about 20 wt. % ultra coarse tungsten carbide having a particle size from about 44 micrometers to about 63 micrometers.

Aspect 3: The composite of Aspect 1, comprising from about 20 wt. % to about 28 wt. % ultra coarse tungsten carbide having a particle size from about 44 micrometers to about 63 micrometers.

Aspect 4: The composite of Aspect 1, comprising from about 18 wt. % to about 22 wt. % ultra coarse tungsten carbide having a particle size from about 44 micrometers to about 63 micrometers.

Aspect 5: The composite of Aspect 1, comprising from about 0 wt. % to about 2 wt. % of a second fraction of ultra coarse tungsten carbide having a particle size greater than about 250 micrometers.

Aspect 6: The composite of Aspect claim 1, comprising from about 0 wt. % to about 8 wt. % of a third fraction of ultra coarse tungsten carbide having a particle size from about 177 micrometers to about 250 micrometers.

Aspect 7: The composite of Aspect 3, further comprising one or more of: (a) from about 0 wt. % to about 2 wt. % of a second fraction of ultra coarse tungsten carbide having a particle size greater than about 250 micrometers, (b) from about 0 wt. % to about 8 wt. % of a third fraction of ultra coarse tungsten carbide having a particle size from about 177 micrometers to about 250 micrometers, (c) from about 10 wt. % to about 25 wt. % of a fourth fraction of ultra coarse tungsten carbide having a particle size from about 125 micrometers to about 177 micrometers, (d) from about 12 wt. % to about 18 wt. % of a fifth fraction of ultra coarse tungsten carbide having a particle size from about 88 micrometers to about 125 micrometers, (e) from about 15 wt. % to about 22 wt. % of a sixth fraction of tungsten carbide having a particle size from about 63 micrometers to about 88 micrometers, (f) and from about 25 wt. % to about 50 wt. % of a seventh fraction of ultra coarse tungsten carbide having a particle size smaller than about 44 micrometers.

Aspect 8: The composite of Aspect 3, comprising from about 0 wt. % to about 2 wt. % of a second fraction of ultra coarse tungsten carbide having a particle size greater than about 250 micrometers, from about 0 wt. % to about 8 wt. % of a third fraction of ultra coarse tungsten carbide having a particle size from about 177 micrometers to about 250 micrometers, from about 10 wt. % to about 25 wt. % of a fourth fraction of ultra coarse tungsten carbide having a particle size from about 125 micrometers to about 177 micrometers, from about 12 wt. % to about 18 wt. % of a fifth fraction of ultra coarse tungsten carbide having a particle size from about 88 micrometers to about 125 micrometers, from about 15 wt. % to about 22 wt. % of a sixth fraction of tungsten carbide having a particle size from about 63 micrometers to about 88 micrometers, and from about 25 wt. % to about 50 wt. % of a seventh fraction of ultra coarse tungsten carbide having a particle size smaller than about 44 micrometers.

Aspect 9: The composite of Aspect 1, comprising from about 10 wt. % to about 18 wt. % nickel.

Aspect 10: The composite of Aspect 1, comprising from about 14 wt. % to about 16 wt. % nickel.

Aspect 11: The composite of Aspect 1, comprising from about 14.5 wt. % to about 15.5 wt. % nickel.

Aspect 12: The composite of any preceding aspect, being infiltrated with a copper containing alloy.

Aspect 13: The composite of any preceding aspect, being infiltrated with an alloy comprising copper, manganese, and zinc.

Aspect 14: The composite of any preceding aspect, comprising no or substantially no cast carbide.

Aspect 15: The composite of any preceding aspect, comprising no cast carbide.

Aspect 16: The composite of any of Aspects 1-13, further comprising a cast carbide.

Aspect 17: The composite of Aspect 12, having a tap density of at least about 7.0 g/cm$^3$.

Aspect 18: The composite of Aspect 12, having a tap density of from about 7.6 g/cm$^3$ to about 9 g/cm$^3$.

Aspect 19: The composite of any preceding aspect, wherein the nickel has an average particle size of less than about 44 micrometers.

Aspect 20: The composite of Aspect 12, having a transverse rupture strength of at least about 170 KSI.

Aspect 21: The composite of Aspect 12, having a volume loss under abrasion testing according to ASTM B611 of less than about 500 mm$^3$.

Aspect 22: A method for preparing a composite, the method comprising contacting ultra coarse tungsten carbide and from about 8 wt. % to about 20 wt. % nickel, wherein at least a portion of the ultra coarse tungsten carbide has a particle size from about 44 micrometers to about 63 micrometers.

Aspect 23: The method of Aspect 22, wherein from about 20 wt. % to about 28 wt. % of the composite comprises ultra coarse tungsten carbide having a particle size from about 44 micrometers to about 63 micrometers.

Aspect 24: The method of Aspect 22, wherein from about 18 wt. % to about 22 wt. % of the composite comprises ultra coarse tungsten carbide having a particle size from about 44 micrometers to about 63 micrometers.

Aspect 25: The method of Aspect 22, wherein from about 0 wt. % to about 2 wt. % of the composite comprises ultra coarse tungsten carbide having a particle size greater than about 250 micrometers.

Aspect 26: The method of Aspect 22, wherein from about 0 wt. % to about 8 wt. % of the composite comprises ultra coarse tungsten carbide having a particle size from about 177 micrometers to about 250 micrometers.

Aspect 27: The method of Aspect 22, further comprising contacting one or more of: (a) from about 0 wt. % to about 2 wt. % of a second fraction of ultra coarse tungsten carbide having a particle size greater than about 250 micrometers, (b) from about 0 wt. % to about 8 wt. % of a third fraction of ultra coarse tungsten carbide having a particle size from about 177 micrometers to about 250 micrometers, (c) from about 10 wt. % to about 25 wt. % of a fourth fraction of ultra coarse tungsten carbide having a particle size from about 125 micrometers to about 177 micrometers, (d) from about 12 wt. % to about 18 wt. % of a fifth fraction of ultra coarse tungsten carbide having a particle size from about 88 micrometers to about 125 micrometers, (e) from about 15 wt. % to about 22 wt. % of a sixth fraction of tungsten carbide having a particle size from about 63 micrometers to about 88 micrometers, (f) and from about 25 wt. % to about 50 wt. % of a seventh fraction of ultra coarse tungsten carbide having a particle size smaller than about 44 micrometers.

Aspect 28: The method of Aspect 22, further comprising contacting from about 0 wt. % to about 2 wt. % of a second fraction of ultra coarse tungsten carbide having a particle size greater than about 250 micrometers, from about 0 wt. % to about 8 wt. % of a third fraction of ultra coarse tungsten carbide having a particle size from about 177 micrometers to about 250 micrometers, from about 10 wt. % to about 25 wt. % of a fourth fraction of ultra coarse tungsten carbide having a particle size from about 125 micrometers to about 177 micrometers, from about 12 wt. % to about 18 wt. % of a fifth fraction of ultra coarse tungsten carbide having a particle size from about 88 micrometers to about 125 micrometers, from about 15 wt. % to about 22 wt. % of a sixth fraction of tungsten carbide having a particle size from about 63 micrometers to about 88 micrometers, and from about 25 wt. % to about 50 wt. % of a seventh fraction of ultra coarse tungsten carbide having a particle size smaller than about 44 micrometers.

Aspect 29: The method of Aspect 22, wherein nickel comprises from about 10 wt. % to about 18 wt. % of the composite.

Aspect 30: The method of Aspect 22, wherein nickel comprises from about 14 wt. % to about 16 wt. % of the composite.

Aspect 31: The method of Aspect 22, wherein nickel comprises from about 14.5 wt. % to about 15.5 wt. % of the composite.

Aspect 32: The method of Aspect 22, wherein after contacting the ultra coarse tungsten carbide and copper, the composite is infiltrated with a copper containing alloy.

Aspect 33: The method of Aspect 32, wherein the copper containing alloy comprises copper, manganese, and zinc.

Aspect 34: The method of Aspect 22, wherein no or substantially no cast carbide is contacted with the ultra coarse tungsten carbide.

Aspect 35: The method of Aspect 22, further comprising contacting a cast carbide.

Aspect 36: The method of Aspect 22, wherein the nickel has an average particle size of less than about 44 micrometers.

Aspect 37: A cutting tool comprising the infiltrated composition of Aspect 12.

Aspect 38: The cutting tool of Aspect 37, wherein the cutting tool comprises a drill bit or a portion thereof.

Aspect 39: The composite of Aspect 1, having a substantially uniform composition.

Aspect 40: The composite of Aspect 1, wherein the composite does not have a core/shell structure.

Aspect 41: The composite of Aspect 12, having a substantially uniform composition.

Aspect 42: The composite of Aspect 12, wherein the composite does not have a core/shell structure.

The examples described herein are put forth so as to provide those of ordinary skill in the art with a complete disclosure and description of how the compounds, compositions, articles, devices and/or methods claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

REFERENCES

1. M. G. Gee, A. Gant, B. Roebuck, "Wear mechanisms in abrasion and erosion of WC/Co and related hardmetals", Wear 263(2007), 137-148.
2. M. Reyes, A. Neville, "Degradation mechanisms of Co-based alloy and WC metal-matrix composites for drilling tools offshore", Wear 255 (2003), 143-156.
3. K. T. Kembaiyan, K. Keshavan, "Combating severe fluid erosion and corrosion of drill bits using thermal spray coating", Wear 186-187(1995), 487-492.
4. Eunji Hong, Bradley Kaplin, Taehoon You, Min-soo Suh, Yong-Suk Kim, Heeman Choe, "Tribological properties of copper alloy-based composites reinforced with tungsten carbide particles", Wear 270 (2011), 591-597.
5. Rong Zhou, Yehua Jiang, Dehong Lu, "The effect of volume fraction of WC particles on erosion resistance of WC reinforced iron matrix surface composites", Wear 255 (2003), 134-138.

6. P. Larsoon, N. Anen, T. Ekstron, S. Hogmark, "Wear of a new type of diamond composite", International Journal of refractory metals and hard materials, 17 (6) (1999) 453-460.
7. M. J. Sandstrom, "The solid particle erosion of tungsten carbide in silicon carbide slurry", Master's thesis, Department of mechanical engineering, University of Utah, 2003.
8. A. Miserez, "Particle reinforced metals of high ceramic content", Material science and Engineering A, 387-389 (2004) 822-831.
9. A. Karimi, Ch. Verdon, J. L. Martin, R. K. Schmid, "Slurry erosion behavior of thermally sprayed WC-M coatings", Wear 186-187 (1995) 480-486.
10. R. S. Montgomery, "The mechanism of percussive wear of tungsten carbide composites", Wear 12 (1968) 309-329.
11. P. K. Deshpande, J. H. Li, R. Y. Lin, "Infrared processed Cu composites reinforced with WC particles", Material science and Engineering A 429 (2006) 58-65.
12. R. K. Kennedy, J. D. Wood, B. M. Weager, "The wetting and spontaneous infiltration of ceramics by molten copper", Journal of Material Science, 35 (2000), 2909-2912.

What is claimed is:

1. A composite comprising at least about 15 wt. % ultra coarse tungsten carbide having a particle size from about 44 micrometers to about 63 micrometers, and from 8 wt. % to about 20 wt. % nickel, wherein the composite is infiltrated with a copper containing alloy.

2. The composite of claim 1, comprising from about 20 wt. % to about 28 wt. % ultra coarse tungsten carbide having a particle size from about 44 micrometers to about 63 micrometers.

3. The composite of claim 1, comprising from greater than 0 wt. % to about 2 wt. % of a second fraction of ultra coarse tungsten carbide having a particle size greater than about 250 micrometers, or from greater than 0 wt. % to about 8 wt. % of a third fraction of ultra coarse tungsten carbide having a particle size from about 177 micrometers to about 250 micrometers.

4. The composite of claim 2, further comprising one or more of: (a) from greater than 0 wt. % to about 2 wt. % of a second fraction of ultra coarse tungsten carbide having a particle size greater than about 250 micrometers, (b) from greater than 0 wt. % to about 8 wt. % of a third fraction of ultra coarse tungsten carbide having a particle size from about 177 micrometers to about 250 micrometers, (c) from about 10 wt. % to about 25 wt. % of a fourth fraction of ultra coarse tungsten carbide having a particle size from about 125 micrometers to about 177 micrometers, (d) from about 12 wt. % to about 18 wt. % of a fifth fraction of ultra coarse tungsten carbide having a particle size from about 88 micrometers to about 125 micrometers, (e) from about 15 wt. % to about 22 wt. % of a sixth fraction of tungsten carbide having a particle size from about 63 micrometers to about 88 micrometers, (f) and from about 25 wt. % to about 50 wt. % of a seventh fraction of ultra coarse tungsten carbide having a particle size smaller than about 44 micrometers.

5. The composite of claim 2, comprising from greater than 0 wt. % to about 2 wt. % of a second fraction of ultra coarse tungsten carbide having a particle size greater than about 250 micrometers, from greater than 0 wt. % to about 8 wt. % of a third fraction of ultra coarse tungsten carbide having a particle size from about 177 micrometers to about 250 micrometers, from about 10 wt. % to about 25 wt. % of a fourth fraction of ultra coarse tungsten carbide having a particle size from about 125 micrometers to about 177 micrometers, from about 12 wt. % to about 18 wt. % of a fifth fraction of ultra coarse tungsten carbide having a particle size from about 88 micrometers to about 125 micrometers, from about 15 wt. % to about 22 wt. % of a sixth fraction of tungsten carbide having a particle size from about 63 micrometers to about 88 micrometers, and from about 25 wt. % to about 50 wt. % of a seventh fraction of ultra coarse tungsten carbide having a particle size smaller than about 44 micrometers.

6. The composite of claim 1, comprising from about 10 wt. % to about 18 wt. % nickel.

7. The composite of claim 1, comprising from about 14 wt. % to about 16 wt. % nickel.

8. The composite of claim 1, comprising no or substantially no cast carbide.

9. The composite of claim 1, having a tap density of at least about 7.0 g/cm$^3$.

10. The composite of claim 1, wherein the nickel has an average particle size of less than about 44 micrometers.

11. The composite of claim 1, having at least one of: a transverse rupture strength of at least about 170 KSI, a volume loss under abrasion testing according to ASTM B611-13 of less than about 500 mm$^3$, or a combination thereof.

12. A method for preparing the composite of claim 1, the method comprising contacting ultra coarse tungsten carbide and from about 8 wt. % to about 20 wt. % nickel, infiltrating the contacted ultra coarse tungsten carbide and nickel with a copper containing alloy, wherein at least a portion of the ultra coarse tungsten carbide has a particle size from about 44 micrometers to about 63 micrometers.

13. The method of claim 12, wherein from about 20 wt. % to about 28 wt. % of the composite comprises ultra coarse tungsten carbide having a particle size from about 44 micrometers to about 63 micrometers.

14. The method of claim 12, wherein from greater than 0 wt. % to about 2 wt. % of the composite comprises ultra coarse tungsten carbide having a particle size greater than about 250 micrometers, or from greater than 0 wt. % to about 8 wt. % of the composite comprises ultra coarse tungsten carbide having a particle size from about 177 micrometers to about 250 micrometers.

15. The method of claim 12, further comprising contacting one or more of: (a) from greater than 0 wt. % to about 2 wt. % of a second fraction of ultra coarse tungsten carbide having a particle size greater than about 250 micrometers, (b) from greater than 0 wt. % to about 8 wt. % of a third fraction of ultra coarse tungsten carbide having a particle size from about 177 micrometers to about 250 micrometers, (c) from about 10 wt. % to about 25 wt. % of a fourth fraction of ultra coarse tungsten carbide having a particle size from about 125 micrometers to about 177 micrometers, (d) from about 12 wt. % to about 18 wt. % of a fifth fraction of ultra coarse tungsten carbide having a particle size from about 88 micrometers to about 125 micrometers, (e) from about 15 wt. % to about 22 wt. % of a sixth fraction of tungsten carbide having a particle size from about 63 micrometers to about 88 micrometers, (f) and from about 25 wt. % to about 50 wt. % of a seventh fraction of ultra coarse tungsten carbide having a particle size smaller than about 44 micrometers.

16. The method of claim 12, further comprising contacting from greater than 0 wt. % to about 2 wt. % of a second fraction of ultra coarse tungsten carbide having a particle size greater than about 250 micrometers, from greater than 0 wt. % to about 8 wt. % of a third fraction of ultra coarse tungsten carbide having a particle size from about 177 micrometers to about 250 micrometers, from about 10 wt. % to about 25 wt. % of a fourth fraction of ultra coarse tungsten carbide having a particle size from about 125 micrometers to about 177 micrometers, from about 12 wt. % to about 18 wt. % of a fifth fraction of ultra coarse tungsten carbide having a particle size from about 88 micrometers to about 125 micrometers, from about 15 wt. % to about 22 wt. % of a sixth fraction of tungsten carbide having a particle size from about 63 micrometers to about 88 micrometers, and from about 25 wt. % to about 50 wt. % of a seventh fraction of ultra coarse tungsten carbide having a particle size smaller than about 44 micrometers.

17. The method of claim 15, wherein nickel comprises from about 10 wt. % to about 18 wt. % of the composite.

18. The method of claim 15, wherein nickel comprises from about 14 wt. % to about 16 wt. % of the composite.

19. A cutting tool comprising the infiltrated composition of claim 1.

20. The cutting tool of claim 19, wherein the cutting tool comprises a drill bit or a portion thereof.

21. The composite of claim 1, having a substantially uniform composition.

22. The composite of claim 1, wherein the composite does not have a core/shell structure.

* * * * *